US012781585B2

(12) United States Patent
Levchenko et al.

(10) Patent No.: US 12,781,585 B2
(45) Date of Patent: Nov. 3, 2026

(54) GAS-GENERATING CHEMICAL HEATING MIXTURES AND DOWNHOLE TOOL ASSEMBLIES WITH CHEMICAL HEATERS EMPLOYING SUCH

(71) Applicant: BiSN Tec Ltd., Risley (GB)

(72) Inventors: Andre Levchenko, Cheshire (GB); Bobby Chancellor, Cheshire (GB); Matthew Naylor, Cheshire (GB); Billy Clark, Cheshire (GB); Didhiti Talapatra, Cheshire (GB); Paul Carragher, Cheshire (GB); Mike Moody, Cheshire (GB)

(73) Assignee: BISN Tec Ltd., Warrington (GB)

( * ) Notice: Subject to any disclaimer, the term of this patent is extended or adjusted under 35 U.S.C. 154(b) by 47 days.

(21) Appl. No.: 18/709,104

(22) PCT Filed: Nov. 10, 2022

(86) PCT No.: PCT/GB2022/052850
§ 371 (c)(1),
(2) Date: May 10, 2024

(87) PCT Pub. No.: WO2023/084220
PCT Pub. Date: May 19, 2023

(65) Prior Publication Data

US 2025/0034963 A1 Jan. 30, 2025

(30) Foreign Application Priority Data

Nov. 12, 2021 (GB) ..... 2116383

(51) Int. Cl.
*E21B 29/02* (2006.01)
*E21B 33/12* (2006.01)
(Continued)

(52) U.S. Cl.
CPC ..... *E21B 29/02* (2013.01); *E21B 33/12* (2013.01); *E21B 33/134* (2013.01); *E21B 36/008* (2013.01)

(58) Field of Classification Search
CPC ..... E21B 29/02; E21B 33/12; E21B 33/134; E21B 36/008
See application file for complete search history.

(56) References Cited

U.S. PATENT DOCUMENTS 4,424,086 A * 1/1984 Christopher ..... C06B 33/02 149/40
6,925,937 B2 * 8/2005 Robertson ..... E21B 29/02 102/202
(Continued)

FOREIGN PATENT DOCUMENTS

GB 2583372 A * 10/2020 ..... E21B 43/105

*Primary Examiner* — Nicole Coy
*Assistant Examiner* — Nicholas D Wlodarski

(57) ABSTRACT

The present invention relates to downhole tool assemblies (50) for use in deploying an alloy plug (61) or seal within a target region of an oil/gas well and clearing/removing well structures from said target regions. The assemblies are provided with a gas-generating chemical heating mixture (58, 59, 60). The heat generated by the chemical heating mixture is employed in heating a downhole target region, while the gas generated is harness to actuate the operation of one or more functional components (54) provided on the assembly to achieve the assembly's particular down-hole operation.

28 Claims, 6 Drawing Sheets

(51) Int. Cl.
*E21B 33/134* (2006.01)
*E21B 36/00* (2006.01)

(56) References Cited

U.S. PATENT DOCUMENTS

| | | | | |
|---|---|---|---|---|
| 10,724,320 | B2 * | 7/2020 | Huang | E21B 29/02 |
| 2020/0362662 | A1 * | 11/2020 | Zhang | C09K 8/46 |
| 2022/0145726 | A1 * | 5/2022 | Head | E21B 33/134 |
| 2023/0220740 | A1 * | 7/2023 | Head | E21B 23/0417 166/55 |

* cited by examiner

GAS-GENERATING CHEMICAL HEATING MIXTURES AND DOWNHOLE TOOL ASSEMBLIES WITH CHEMICAL HEATERS EMPLOYING SUCH

FIELD OF THE INVENTION

The present invention relates to downhole tool assemblies with chemical heaters for use in downhole environments, such as oil and gas wells.

BACKGROUND OF THE INVENTION

A wide range of operations conducted downhole in oil/gas wells can require that heat is delivered to a downhole target region within an oil/gas well. The heating of the target region can be achieved by employing a downhole tool assembly that has a chemical heater, which can be operating to heat the target region to achieve a variety of tasks.

One task carried out using downhole tool assemblies with chemical heating means is the deployment of alloy plugs or seals within a target region of an oil/gas well. International patent applications WO2011/151271 and WO2014/096858 represent examples of assemblies used in the downhole deployment of alloy plugs/seals.

Typically when setting an alloy plug or seal downhole, which in most cases form a metal on metal bond with existing well structures such as well tubing or casing, a heating tool is provided in the downhole target region at the same time as a quantity of alloy.

The heat generated by the heating tool is used to melt the alloy, after which the alloy is allowed to cool and re-solidify to form an alloy plug or seal within the target region of the oil/gas well.

The most common types of downhole heaters used are electrical heaters, which receive power from above ground via a wireline connection, and chemical heaters, which use an on board chemical reaction heat source that undergoes an exothermic reaction to generate heat in the target region of the oil/gas well.

Thermite and thermite mixtures are an example of a chemical reaction heat source typically employed in the chemical heaters of assemblies used in the formation of alloy plugs and seals in oil/gas wells.

Another task carried out using downhole tool assemblies with chemical heating means is the clearance or removal of well structures, such as pre-existing alloy seals or portions of well tubing/casing, from within a target region of an oil/gas well. International patent application WO2015/150828 relates to assemblies used in the clearance of downhole target regions.

Oftentimes, in addition to the chemical heater, the downhole tool assembly will also comprise additional functional components that perform a role in a particular downhole operation (e.g. the formation of an alloy plug or seal).

One example of a functional component that plays an important role in the formation/removal of alloy plugs and seals is a dump bailer, which can used to deliver alloy downhole and then deploy it into a target region when the time is right.

Another example of a functional component that can play an important role in alloy plugging/sealing operations in particular is an expandable base. The expandable base is generally provided at the leading end (i.e. the end that is delivered downhole first) of a downhole tool assembly and can be expanded to provide a base that reduces/prevents the amount of alloy run off during the downhole operation.

An example of a functional component that plays an important role in the removal/clearance of well structures from a target region of an oil/gas well is perforation tool. According to the clearance methods described in WO2015/150828, perforating the surrounding well tubing/casing can enhance the heating effects achieved by the chemical heater.

Providing a chemical heater and one or more functional components in a single combined downhole tool assembly enables a downhole operation, such as the deployment of an alloy plug, to be carried out in a single run. This provides significant savings in terms of time and cost.

International patent application WO2014/096858 describes a downhole tool assembly that is suitable for use in deploying alloy plugs within oil/gas wells, the assembly comprises a chemical heater, a dump bailer and an expandable base.

During a downhole operation each element (e.g. heater, dump bailer, expandable base) of the assembly must be operated in a certain order. For example, in the case of the assembly described in WO2014/096858, the expandable base is expanded before the alloy is deployed by the dump bailer so as to minimize the loss of alloy downhole due to run off.

In order to help achieve the sequential operation of the various elements of a downhole tool assembly typically each component may be individually controlled. However, this can lead to complex control systems that can be more costly and are also more vulnerable to fail downhole. This increases the potential for further costs due to extended well down time.

SUMMARY OF THE INVENTION

With a view to addressing the issues identified above the present invention provides downhole tool assemblies for use in downhole operations and associated methods of carrying out downhole operations in oil/gas wells.

In a first aspect of the present invention there is provided a downhole tool assembly for use in deploying an alloy plug or seal within a target region of an oil/gas well, said assembly comprising: a chemical heater with a main body that defines an enclosure that houses a chemical reaction heat source that contains at least one gas generating additive, wherein the heater is configured to generate sufficient heat to melt alloy within a downhole environment; and at least one functional component associated with the deployment of the alloy plug or seal, each component being configured to be operated by the action of an actuator; wherein each actuator is arranged in fluid communication with the enclosure of the chemical heater such that gas generated during the reaction of the chemical reaction heat source can be harnessed to operate said functional component.

Although it is envisioned that alloy can be deployed down hole separately from the assembly, preferably the assembly further comprises an alloy for use in the formation of the alloy seal. In this way the assembly to can be used to deliver the alloy downhole to the target region in which the alloy is then melted to form a seal/plug.

In particular, the metal alloy can be used to repair a packer or cement completion within the annulus between a tubing and a casing or indeed the tubing/casing and the surrounding formation. In other operations the metal alloy can be used to form a plug within the inner diameter of a well tubing, well casing or even the entire formation.

Preferably the alloy used is provided in the form of a low melting alloy that has melting point of less than 300° C. These low melting alloys are sometimes also referred to as fusible alloys. With that said, it will be appreciated that in order for the alloy to be capable of forming a solid alloy plug or seal within the downhole environment the melting point of the alloy must not be lower than the normal temperature in the downhole target region, which is typically below 177° C. and most commonly between 5 and 50° C.

Further preferably the alloy is a bismuth-based alloy. The use of bismuth-based alloys in the formation of downhole seals and plugs is considered advantageous because of Bismuth's tendency to contract upon melting and then expand again on cooling/re-solidification. Bismuth-based alloys, which may also qualify as low melt alloys, have the additional benefit of being resistant to corrosion in downhole conditions.

It is appreciated that on the rare occasions where the temperature in the downhole target region is above this temperature (a small percentage of wells can reach temperatures of up to 320° C.), an alloy with a higher melting point may be employed. One example of a suitable higher melting point alloy is the germanium/bismuth alloy disclosed in International PCT application WO2014/096857.

In a second aspect of the present invention there is provided a downhole tool assembly for use in removing or clearing a well structure from a target region of an oil/gas well, said assembly comprising: a chemical heater with a main body that defines an enclosure that houses a chemical reaction heat source that contains at least one gas generating additive, wherein the heater is configured to generate sufficient heat to melt the well structure within a downhole environment; and at least one functional component associated with the removal or clearance of the well structure, each component being configured to be operated by the action of an actuator; wherein each actuator is arranged in fluid communication with the enclosure of the chemical heater such that gas generated during the reaction of the chemical reaction heat source can be harnessed to operate said functional component.

Preferably the well structure to be cleared/removed is selected from an alloy plug or seal; a well tubing/casing; previously deployed well tools; cabling, tubing and other lines deployed within the oil/gas well.

It is envisaged that in the assemblies of both the first and second aspects of the present invention, the use of a chemical reaction mixture that is configured to generate gas as it undergoes its exothermic reaction facilitates the co-ordination of the operation of one or more functional components with the chemical heater. This linking of the operation of the functional components to the activation of the chemical heater removes the need for separate independently operable control mechanisms for each functional component.

This simplifies the control mechanisms for tool assemblies, which helps to reduce both the costs associated with downhole operations and the potential for downhole operational failures of the various functional components that make up the assembly.

The following preferable features are considered applicable to downhole tool assemblies of both the first and second aspects of the present invention.

Preferably the chemical reaction heat source comprises a thermite based heat source. Further preferably the thermite based heat source comprises: between 7.5 and 35.5% by weight of an oxidizable metal; between 64.0 and 92.0% by weight of an oxidizing reagent; and between 0.5 and 30.0% by weight of said gas generating additive.

Preferably the gas generating additive may be a metal carbonate. Further preferably the gas generating additive is selected from a group consisting of $BaCO_3$, $BeCO_3$, $ZnCO_3$, $MgCO_3$, $CaMg(CO_3)_2$, $CaCO_3$, $SrCO_3$, $MnCO_3$, $Fe(CO_3)_2$ and combinations thereof.

These additives are considered particularly preferable because of their tendency to decompose when heated to form carbon monoxide and carbon dioxide gas; neither of which condense into solids upon cooling. As a result, the use of the preferred additives in the thermite mixture of the chemical heater does not create residues that might otherwise impair the integrity of any alloy seal/plug formed downhole using the assembly.

Further, it is appreciated that, as the identified metal carbonates decompose at different temperatures below 1200° C., the selection of the gas generating additive can be based, at least in part, on the expected temperature output of the thermite mixture used in the thermite based heat source.

Preferably the oxidizable metal may be selected from a group consisting of Al, B, Mg, Mn, Ti, AlSi and AlMg. Further, the oxidizing reagent may be selected from a group consisting of CuO, $Cu_2O$, $Cr_2O_3$, $WO_3$, $Fe_2O_3$, $Fe_3O_4$, $MnO_2$, $Bi_2O_3$, $MoO_3$ and $PbO_2$.

It is envisioned that the oxidizable metals and the oxidizing reagents can be selected in various combinations to help control the heat generated by the thermite based heat source housed within the heater of the assembly.

It is envisioned that the thermite based heat source enclosed in the heater may be provided in the form of pellets, a paste, a powder, solid block(s), fragmented solid block(s) or combinations thereof. Each form of thermite has associated benefits, and as such can be selected to tailor the configuration of the chemical heater for different tasks.

Preferably the chemical heater enclosure may house one or more solid blocks of thermite material and at least one of block is formed from thermite based heat source that contains at least one gas generating additive. In this way the generation of gas within the chemical heater enclosure can be localized.

Preferably the amount of gas generating additive present in each block may vary from block to block. In this way, the levels of gas generated within the chemical heater enclosure can be controlled to again achieve localized and/focused gas build-up.

Preferably each actuator may be arranged adjacent a block formed from the thermite based heat source that contains at least one gas generating additive. In this way the gas generated during the thermite reaction builds up in close proximity to the actuator, thereby helping achieve the efficient actuation of an actuator (and its associated functional component).

In those embodiments where the thermite material is provided in the form of blocks, it is preferable that the blocks comprise one or more bores running through them such that, when the blocks are stacked, the bores of blocks stacked within the enclosure are aligned to facilitate the passage of gas therethrough. In this way the passage of gas to the actuators is improved, which helps to achieve an efficient actuation of the actuator.

Preferably the pressure built up within the enclosure of the chemical heater by the generation of gas may act, via said actuator, to directly operate at least one functional component.

Alternatively the pressure built up within the enclosure of the chemical heater by the generation of gas may act, via said actuator, to indirectly operate said function component(s).

In those embodiments where indirect actuation takes place, the potential energy is preferably stored in the form of a depressurized region of the assembly or an elastically deformed spring.

Although not necessarily always the case, it is envisaged that the direct approach is more appropriate in those chemical heaters having a thermite based heat source that is capable of producing larger quantities of gas, either due to the overall quantity of the mixture or perhaps the percentage quantities of gas producing additives.

In embodiments of the present invention where lower quantities of gas are evolved by the reaction of the thermite based heat source housed within the heater enclosure, it is envisaged that the indirect approach is better suited.

As noted above, the downhole tool assembly of the present invention is provided with one or more functional components that perform a function that is associated with the downhole task that is to be carried out.

As such, functional components associated with the deployment of an alloy plug or seal preferably include a dump bailer, an expandable base, an expandable heat retaining baffle, slips, and an assembly component connection mechanism.

Whereas functional components associated with the removal or clearance of a well structure preferably include a perforation tool, an expandable junk basket, an expandable heat retaining baffle, slips, and a well structure retrieval mechanism.

Preferably one functional component of the assembly may be an expandable base located downhole of the chemical heater that, when expanded, provides a base upon which the alloy seal is formed; and wherein the action of the gas on an associated actuator triggers the base to expand radially outward towards a surrounding well structure.

Preferably one functional component of the assembly may be a dump bailer housing alloy, preferably in the form of alloy shot or beads, for use in the formation of the alloy seal; and wherein the action of the gas on an associated actuator triggers the dump bailer to deploy the alloy.

Preferably one functional component of the assembly may be an expandable heat retaining baffle located up-hole of the chemical heater that, when expanded, restricts the upward flow of heated well fluids within well; and wherein the action of the gas on an associated actuator triggers the heat retaining baffle to expand radially outward towards a surrounding well structure.

Preferably one functional component of the assembly may be slips that can be engaged to secure the position of the assembly relative to the surrounding well structure; and wherein the action of the gas on an associated actuator triggers the slips to engage with the surrounding well structure.

Preferably one functional component of the assembly may be an assembly component connection mechanism that locks a first section of the assembly to a second section of the assembly; and wherein the action of the gas on an associated actuator disengages the connection mechanism so that the first and second assembly sections can be separated from one another.

Preferably one functional component may be a perforation tool; and wherein the action of the gas on an associated actuator fires the perforation tool.

Preferably one functional component may be an expandable junk basket located downhole of the chemical heater that, when expanded, catches debris created during the removal or clearance of said well structure; and wherein the action of the gas on an associated actuator triggers the junk basket to expand radially outward towards a surrounding well tubing or well casing.

Preferably one functional component may be a well structure retrieval mechanism; and wherein the action of the gas on an associated actuator causes the well structure retrieval mechanism to engage with the well structure so that it can be retrieved from the oil/gas well.

In its broadest form the downhole tool assemblies of both the first and second aspects of the present invention are provided with a single functional component that is operated by the gas generated by the chemical heater. However, preferably the assembly of the present invention may comprise a plurality of functional components each having an associated actuator, such that the operation of each component is independently controllable.

It is envisioned that providing the downhole tool assembly with multiple functional components associated with the desired task (i.e. alloy plug/seal formation or the clearance/removal of a well structure) can be carried out using the tool assembly in a single trip.

Further preferably the actuators may be configured such that the functional components are operated in a pre-determined order.

In a third aspect of the present invention, there is provided a method of deploying an alloy plug or seal within an oil/gas well using a downhole tool assembly having a chemical heater and at least one functional component associated with the deployment of the alloy plug or seal, said method comprising: providing the chemical heater with a chemical reaction heat source that contains at least one gas generating additive; delivering the downhole tool assembly to a target region within the oil/gas well and initiating the chemical heater to generate heat; harnessing the gas generated during the reaction of the chemical reaction heat source within the chemical heater to drive an actuator that acts, either directly or indirectly, to operate said at least one functional component.

In a fourth aspect of the present invention, there is provided a method of removing or clearing a well structure from an oil/gas well using a downhole tool assembly having a chemical heater and at least one functional component associated with the removal or clearance of the well structure, said method comprising: providing the chemical heater with a chemical reaction heat source that contains at least one gas generating additive; delivering the downhole tool assembly to a target region within the oil/gas well and initiating the chemical heater to generate heat; harnessing the gas generated during the reaction of the chemical reaction heat source within the chemical heater to drive an actuator that acts, either directly or indirectly, to operate said at least one functional component.

The following preferable features are considered applicable to methods of both the third and fourth aspects of the present invention.

Preferably the chemical reaction heat source comprises a thermite based heat source. Further preferably the thermite based heat source comprises: between 7.5 and 35.5% by weight of an oxidizable metal; between 64.0 and 92.0% by weight of an oxidizing reagent; and between 0.5 and 30.0% by weight of said gas generating additive.

Preferably the gas generating additive may be a metal carbonate. Further preferably the gas generating additive is selected from a group consisting of $BaCO_3$, $BeCO_3$, $ZnCO_3$, $MgCO_3$, $CaMg(CO_3)_2$, $CaCO_3$, $SrCO_3$, $MnCO_3$, $Fe(CO_3)_2$ and combinations thereof.

Preferably the oxidizable metal may be selected from a group consisting of Al, B, Mg, Mn, Ti, AlSi and AlMg. Further, the oxidizing reagent may be selected from a group consisting of CuO, $Cu_2O$, $Cr_2O_3$, $WO_3$, $Fe_2O_3$, $Fe_3O_4$, $MnO_2$, $Bi_2O_3$, $MoO_3$ and $PbO_2$.

It is envisioned that the oxidizable metals and the oxidizing reagents can be selected in various combinations to help control the heat generated by the thermite based heat source housed within the heater of the assembly.

Once again, it is envisioned that the thermite based heat source enclosed in the heater may be provided in the form of a paste, a powder, solid block(s), fragmented solid block(s) or combinations thereof. Each form of thermite has associated benefits, and as such can be selected to tailor the configuration of the chemical heater for different tasks.

Preferably functional components associated with the deployment of an alloy plug or seal include a dump bailer, an expandable base, an expandable heat retaining baffle, slips, and an assembly component connection mechanism.

Whereas functional components preferably associated with the removal or clearance of a well structure preferably include a perforation tool, an expandable junk basket, an expandable heat retaining baffle, slips, and a well structure retrieval mechanism.

When the downhole tool assembly comprises multiple functional components including the expandable base, the operation of the functional components is preferably prioritized so that the expandable base is operated first. In this way the base is deployed to prevent the loss of alloy downhole before the alloy is released (i.e. by melting, by deployment from a dump bailer, or simply dropped downhole from the surface).

When the downhole tool assembly comprises multiple functional components including the assembly component connection mechanism, the operation of the functional components is preferably prioritized so that the assembly component connection mechanism is operated last.

In this way, once the alloy has been melted and the heater is no longer required, the heater can be detached from the rest of the assembly and retrieved from the well. With that said, it is also envisioned that the assembly component connection mechanism may be located at a range of points on the assembly depending on which elements of the assembly are to be retrieved or left downhole.

Preferably the operation of the functional components may be prioritized by configuring the actuator associated with each functional component. In this way, the actuators of those functional components that are to be operated first can be configured to be easier to actuate than the actuators that are associated with other functional components on the assembly. It is envisaged that this could be achieved by varying the extent to which each actuator is resiliently biased towards its default position (i.e. the position in which it does not cause the operation its associated functional component).

BRIEF DESCRIPTION OF THE DRAWINGS

The present invention will now be described with reference to the preferred embodiments shown in the drawings, wherein.

DETAILED DESCRIPTION OF THE PREFERRED EMBODIMENTS

Figure 1:
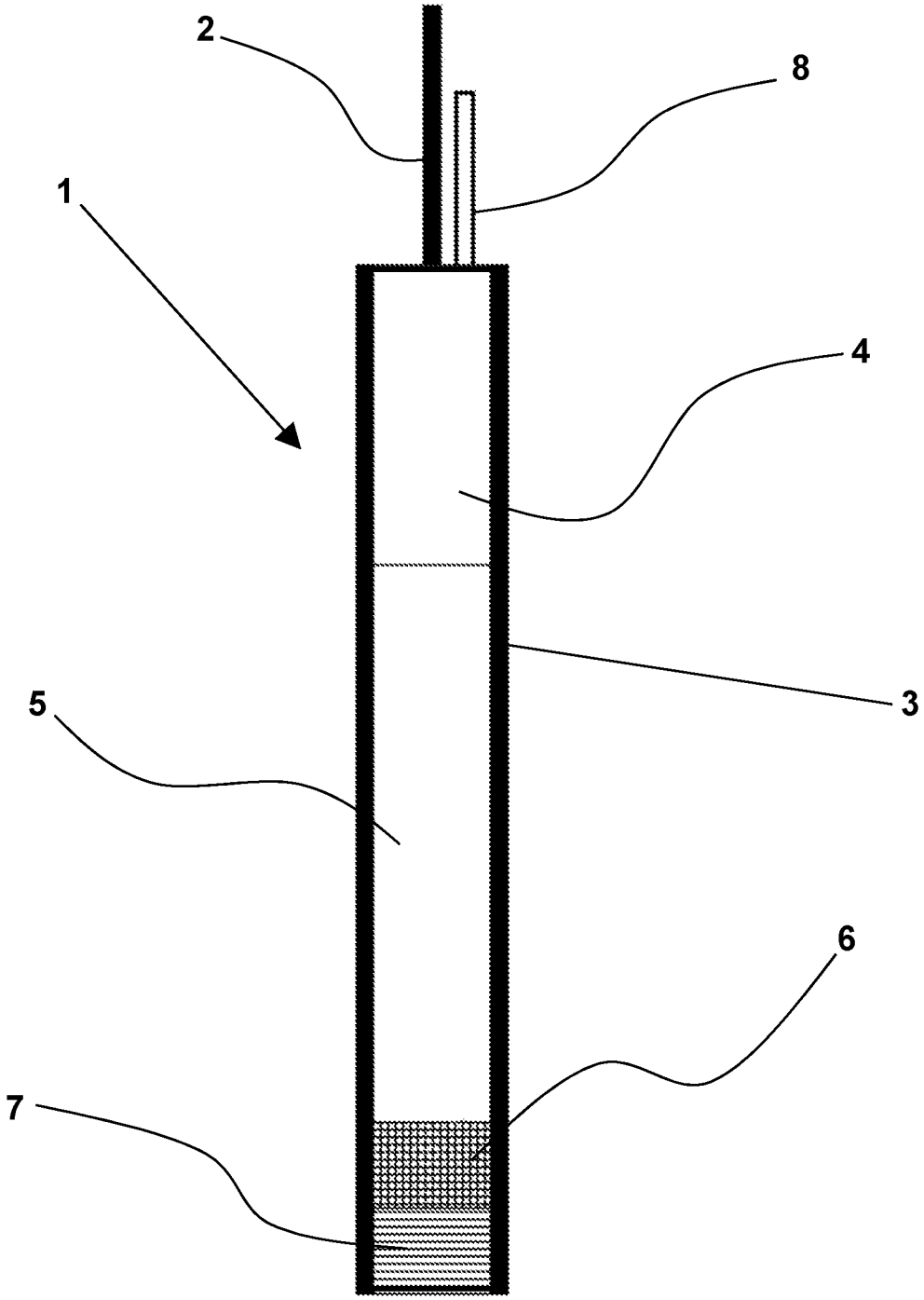
FIG. 1 shows a preferred embodiment of the chemical heater of a downhole tool assembly of the present invention.

In its broadest aspect, the present invention provides a downhole tool assembly that comprises a thermite-based chemical heater and at least one functional component, wherein the thermite mixture is configured to not only generate heat but also gas once the mixture is initiated/ignited.

The gas produced by the heater is then harnessed to actuate the operation of the functional component to perform a role associated with a given downhole task. That task being either the deployment of an alloy plug or seal within a target region of an oil/gas well or the removal/clearance of a well structure (such as an existing alloy plug/seal) from a target region of an oil/gas well.

By configuring the chemical heater to not only generate heat but also gas, it is possible to simplify the initiation mechanisms employed to operate the functional components of the assemblies of the present invention.

That is to say, rather than providing a separate initiation system for the heater and each of the assembly's functional components, a simplified initiation system can be used to initiate the operation of the chemical heater, which then, through the action of the gas built up during the thermic reaction, initiates the operation of said functional components.

Various preferred embodiments of the downhole tool assembly of the present invention, which are shown either in whole or in part in FIGS. 1 to 6, will be described hereinafter. It is envisaged that some of the functional components described are specific to either the deployment of alloy plugs/seals or the removal/clearance of well structures, whereas other functional components can be employed in both types of downhole operation.

However before describing the assemblies in any detail, it is considered appropriate to consider the preferred embodiments of the gas producing chemical reaction heat sources used in accordance with the present invention, which are thermite based.

In general thermite is a pyrotechnic composition of a metal powder and a metal oxide that produces an exothermic oxidation-reduction reaction known as a thermite reaction.

Although a range of powdered metals can be used, Aluminium (Al) is a preferred choice for the thermite mixtures used in the chemical heaters of the present invention. Other preferred choices include Aluminium Silicon (AlSi), Magnesium Aluminium (AlMg), Boron (B), Magnesium (Mg), Manganese (Mn) and Titanium (Ti).

With regards to the metal oxide, cupric oxide (CuO) is considered particularly preferable for the thermite mixtures used in the present invention. However other suitable examples include $Cu_2O$, $Cr_2O_3$, $WO_3$, $Fe_2O_3$, $Fe_3O_4$, $MnO_2$, $Bi_2O_3$, $MoO_3$ and $PbO_2$.

It is envisaged that a range of gas generating additives could be introduced into the core thermite mixture (i.e. the metal powder and the metal oxide) provided they evolve gas during the thermite reaction. However, metal carbonates are considered particularly preferable because they degrade during the thermite reaction to produce Carbon Monoxide (CO) and Carbon Dioxide ($CO_2$) gas. These gases are considered optimum because they do not solidify within the temperature ranges typically found downhole and therefore they do not create residues in the downhole target region that might have a negative impact on the seals formed between the alloy and the downhole structures (i.e. well tubing/casing).

Examples of preferred metal carbonates include $BaCO_3$, $BeCO_3$, $ZnCO_3$, $MgCO_3$, $CaMg(CO_3)_2$, $CaCO_3$, $SrCO_3$, $MnCO_3$, $Fe(CO_3)_2$.

It will appreciated that the above identified components (i.e. metal powder, metal oxide, gas generating additive) can be combined in a variety of ways to achieved a thermite based heat source that is capable of generating both heat and gas during an exothermic reaction.

However, preferably the gas generating thermite based heat source employed in the heater of the downhole tool assembly of the present invention comprises the following composition:

- between 7.5 and 35.5% by weight of an oxidizable metal (i.e. metal powder);
- between 64.0 and 92.0% by weight of an oxidizing reagent (i.e. metal oxide);
- between 0.5 and 30.0% by weight of said gas generating additive.

A preferred example of the gas producing chemical reaction heat source of the present invention comprises: Al 18.4% by weight; CuO 81.6% by weight; $CaCO_3$ 10% by weight.

Although it is essential to the present invention that the chemical heater comprises a chemical reaction heat source that is capable of generating gas during the reaction of the thermite mixture, this does not preclude the presence within the chemical heater of additional chemical reaction mixtures that do not contain a gas generating additive.

That is to say, a chemical heater in accordance with the present invention may contain multiple chemical reaction heat sources, which may or may not all be thermite based, but not necessarily all of them are configured to generate gas.

It is also appreciated that when the chemical reaction heat source is thermite based, the gas generating and the non-gas generating chemical reaction heat sources can be provided in a variety of physical forms that include solid blocks, fragmented solid blocks, pellets, paste and powder.

In situations where multiple thermite based heat sources are present within a chemical heater (at least one of which comprises a gas generating additive), it is envisaged that they do not need to be provided in the same form. That is, one thermite based heat source could be provided in block form whilst another chemical reaction heat source could be provided in powder formed.

Against this backdrop a preferred embodiment of a chemical heater of a downhole tool assembly in accordance with the present invention will now be described with reference to FIG. 1.

For the sake of clarity FIG. 1 shows the chemical heater 1 without an associated functional component that, in accordance with the present invention, would be operated by the gas generated by the heater.

The chemical heater 1 is connected to a delivery support 2, which may take the form of a wireline, that is used to deliver the chemical heater and the rest of the associated downhole tool assembly (not shown) down hole to a desired target region within an oil/gas well.

The chemical heater 1 comprises a main body 3 that is preferably formed from steel. The main body 3, which is tubular in shape and closed at both ends, defines an enclosure that houses the chemical components that react to generate the heat that can be used to melt an alloy or an existing well structure within a target region of the oil/gas well.

The contents of the main body 3 of the preferred heater 1 shown in FIG. 1 will now be described by working from the trailing end (i.e. the top of the chemical heater) to the leading end (i.e. the end of the heater that is deployed down hole first).

The top layer 4 is a gas generating chemical reaction heat source that is provided in the form of fragmented block thermite, which is also referred to as crumble. Fragmented block or 'crumble' thermite mixtures are described in International PCT application WO2017191471 A1.

The top layer 4 has the dual purpose of generating both heat and gas during the exothermic reaction.

The next layer down is a non-gas generating chemical reaction heat source 5 that is also preferably provided in the form of fragmented solid blocks of a thermite mixture (i.e. crumble). The purpose of this layer is to generate heat.

It is envisaged that thermite present in both layers 4 and 5 could alternatively be provided in a form other than crumble, such as block, powder, paste or even in the form of a fluid.

Below the crumble layer 5 is provided a layer of red thermite 6. This layer 6 is provided to effectively initiate the exothermic reaction of the other thermite layers within the chemical heater 1.

At the base of the chemical heater 1 is provided a layer of sand 7. The sand layer, which is not considered essential, if provided to create a cool spot within the heater.

The gas generating top layer of the thermite based heat source 4 is provided adjacent to a gas outlet 8, which represents the only exit route for any gas generated during the exothermic reaction of the thermite within the main body 3 of the chemical heater 1.

It is appreciated that restricting the escape of the gas generated within the chemical heater 1 to a single exit point causes the gas escaping via the gas outlet 8 to be pressurized. The pressurized gas can then be harnessed to drive an actuator that in turn operates a functional component of the downhole tool assembly.

The actuation of a range of functional components that are associated with the formation of alloy seals/plugs within a target region of an oil/gas wells and/or the removal/clearance of a well structure from a downhole target region will now be described with reference to the preferred embodiments shown in FIGS. 2 to 5.

Figure 2:
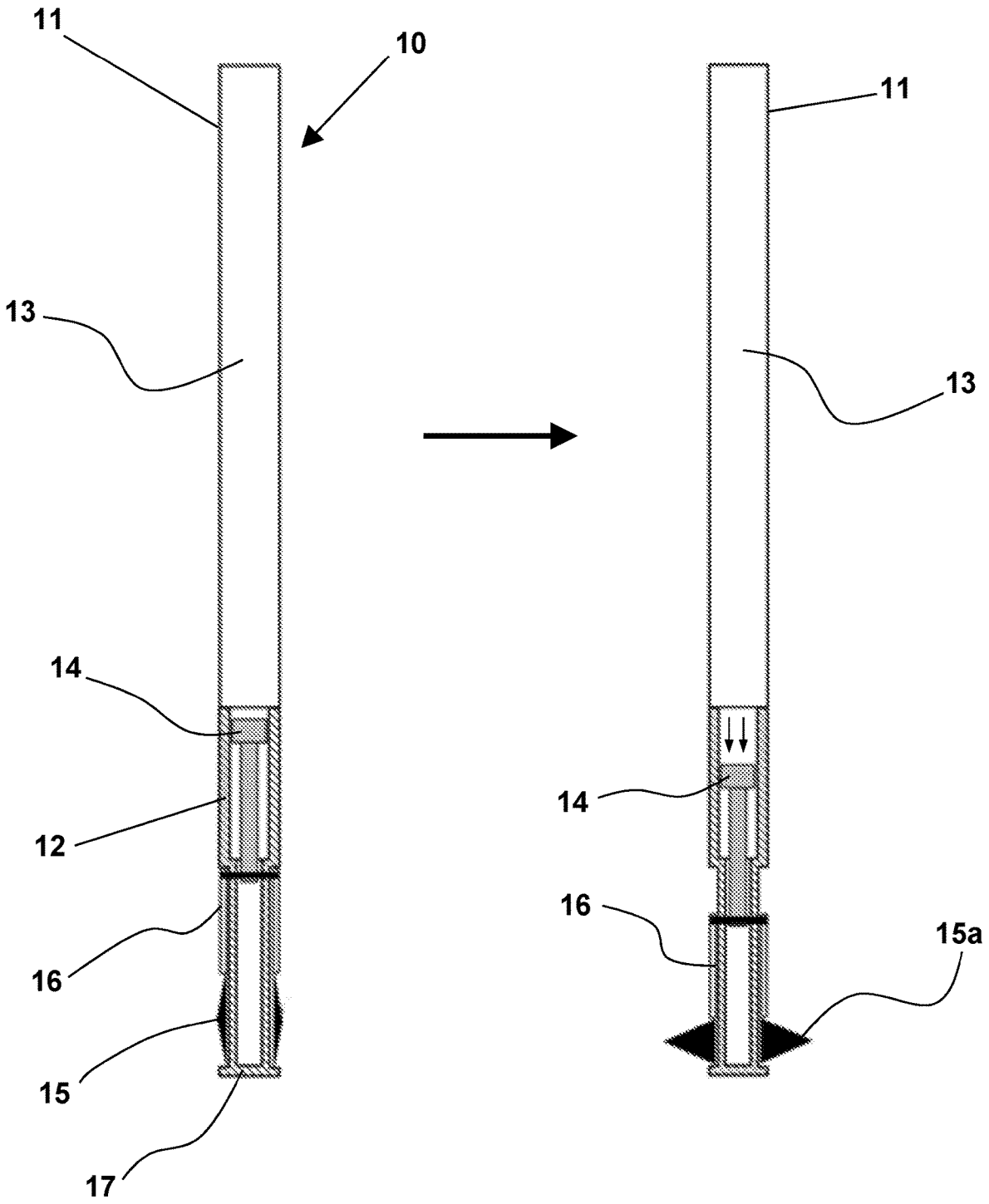
FIG. 2 shows a portion of a downhole tool assembly of the present invention with a preferred embodiment of an expandable base functional component.

FIG. 2 shows a preferred embodiment of a downhole tool assembly 10 that is in accordance with the present invention. The assembly 10 shown in FIG. 2 essentially comprises a chemical heater 11 and a functional component that is associated with the formation of alloy seals/plugs, which takes the form of an expandable base 12.

It is envisaged that, although not shown, the chemical heater 11 is connected, either directly or indirectly, to a well delivery support (e.g. wireline, slick line, coil tubing) that is in turn connected to a deliver means that is located above ground. In this way the delivery means can be used to deliver the assembly down hole to a target region with an oil/gas well and, if necessary, retrieve all or part of the assembly from the well once the alloy plug/seal has been deployed in the target region.

The expandable base 12 is provided on the leading end of the chemical heater 11, such that the expandable base is delivered downhole before the chemical heater 11.

The chemical heater 11 comprises a main body that encloses a chemical heat source that comprises at least one thermite based heat source that contains a gas generating additive.

As explained with reference to the preferred chemical heater embodiment shown in FIG. 1, the chemical heat source enclosed within the main body of the heater may comprise a single thermite based heat source or a combination of multiple different thermite based heat sources. Provided that the chemical heater comprises at least one gas generating chemical heat source, it is envisaged that a range of different arrangements of chemical heat sources can be employed without departing from the general concept of the present invention.

In the case of the chemical heater 11 shown in FIG. 2, a single gas generating chemical heat source 13 is employed throughout the heater's main body.

It is envisaged that other arrangements of chemical heat sources (e.g. see example shown in FIG. 1) could be adopted instead. With that said, in arrangements where only some of the chemical heat sources are capable of generating gas, it is considered preferable that the gas generating thermite mixture is arranged within the chemical heater main body such that it is adjacent to the actuator of a functional component.

In FIG. 2, where the functional component of the assembly 10 is an expandable base 12, it will be seen that the actuator 14 is positioned adjacent the base of the chemical heater 11. This juxtaposition of the actuator 14 with the gas generating chemical heat source ensures that any gas generated during the exothermic reaction of the thermite mixture can make a rapid impact on the actuator 14.

In order to maximize the effectiveness of the gas generated by the chemical heat source, the main body of the chemical heater is configured so that gas can only escape via a predetermined gas outlet, which is in fluid communication with the actuator 14.

In FIG. 1 the gas outlet is shown as a tube 8 that transfers the gas from within the chemical heater 1 to a location where an actuator for a functional component is located. However it is envisioned that the actuator may interact directly with the main body of the chemical heater, wherein for example the heater main body is open at one end and the actuator is arranged to combine with the main body to enclose the chemical heat source(s).

FIG. 2 shows one such arrangement, wherein the chemical heater 11 combines with the expandable base 12, and in particular the actuator 14, to define a chamber that encloses the chemical heat source(s) and any gas generated during the exothermic reaction.

It is envisioned that a gas tight seal can be achieved between the main body of the chemical heater 11 and the expandable base 12 in a number of ways. In preferred embodiments the adjoining ends of the chemical heater 11 and the expandable base 12 are provided with complementary screw threads that facilitate a secure and gas tight seal between the two components of the assembly 10.

In some embodiments of the downhole tool assembly, the chemical heater and the expandable base could be welded together. Whilst in other embodiments the chemical heater and the expandable base may be connected to one another by way of a disengageable connection mechanism. In this way the heater can be disconnected from the expandable base and retrieved once the downhole operation (i.e. alloy seal/plug formation) is complete. In such embodiments suitable seals may be employed.

Providing limited exit paths for the gas generated within the chemical heater creates a focused build-up of a pressurized gas which can be harnessed to drive the actuator 14 that is arranged in fluid communication with the chemical heater 11.

In the embodiment shown in FIG. 2 the actuator 14 comprises a piston that is slideably mounted within the main body of the expandable base 12.

At one end of the actuator is a piston head that presents a surface against which the gas pressure can push. The opposite end of the actuator 14 is attached to a sleeve 16 that is mounted on the outside of the expandable base 12. The actuator is connected to the externally mounted sleeve via connection means that ensure that any sliding movement of the actuator translates to a sliding movement of the sleeve 16 relative to the main body of the expandable base 12.

At the leading end of the expandable base 12 is provided a ring of elastomeric material 15. The elastomeric ring 15 is seated on the outside of the expandable base between the slidable sleeve 16 and an annular projection 17.

The positioning of the elastomeric ring 15 in this way means that, when the sleeve 16 is urged towards the annular projection 17 of the expandable base 12 by the action of the gas driven actuator 14, the elastomeric ring 15 is squeezed. The action of squeezing the elastomeric ring 15 causes it to change from a first state, in which the ring 15 site relatively flush against the side of the expandable 12, to a second state, in which the ring 15A bulges radially outwards. This transition is shown in FIG. 2.

It will be appreciated that, when the downhole tool assembly 10 is deployed within an oil/gas well, the operation of the chemical heater will generate gas that will build-up within the chemical heater 11 and, when the gas pressure is sufficient, drive the actuator piston 14 downwards. This action on the actuator piston 14 in turn operates the transition of the expandable base from a non-expanded state (where the elastomeric ring sits relatively flush) to an expanded state (where the elastomeric ring is caused to bulge radially outward towards a surround well structure (i.e. well tubing or casing).

The expansion of the elastomeric ring 15 radially outwards serves to at least partially bridge the gap between the downhole tool assembly 10 and the surrounding well tubing/casing. In this way the elastomeric ring provides a base for an alloy plug or seal to build from.

In the absence of the expandable base (or any alternative run-off measures) any alloy delivered to the downhole target region in a flowable state (be that in molten form or in the form of alloy shot or pellets) would be at risk of being lost downhole before the formation of the alloy seal/plug could be completed.

In the case of the assembly 10 shown in FIG. 2, the activation of the chemical heater 11 would in turn trigger the expansion of the expandable base through the medium of the gas that is generated during the heater's primary heating function.

Although not shown in FIG. 2, it is envisaged that a suitable alloy, such as a bismuth-based alloy, could be mounted on the outside of the heater main body. In this way the alloy that is to be used in the formation of a downhole alloy plug or seal is delivered down hole at the same time as the heater, which allows the sealing/plugging operation to be carried out in a single trip.

Following the activation of the chemical heater the alloy mounted on its exterior gradually begins to heat up, whilst at the same time gas is being generated within the interior of the chemical heater. The assembly 10 is configured to ensure that sufficient gas is generated to operate (i.e. expand) the expandable base 12 before the alloy mounted on the exterior of the chemical heater becomes molten. In this way, when the alloy eventually begins to flow down the assembly the expandable base 12 is already in its expanded state and ready to serve as a base or platform for the alloy seal/plug to build from.

Although it is a preferred arrangement for the alloy to be delivered down hole mounted on the outside of the chemical heater, other mechanisms for deploying the alloy down hole are contemplated.

These mechanisms range from simply dumping alloy shot down hole from a hopper located at the surface to the use a dump bailer mounted on the downhole tool assembly. Dump bailers represent another example of a functional component that can be operated using the gas generating by the chemical heat source of a chemical heater in accordance with the present invention. The operation of the dump bailer will be described in more detail below with respect to the preferred embodiments shown in FIGS. 4 and 6.

Figure 3:
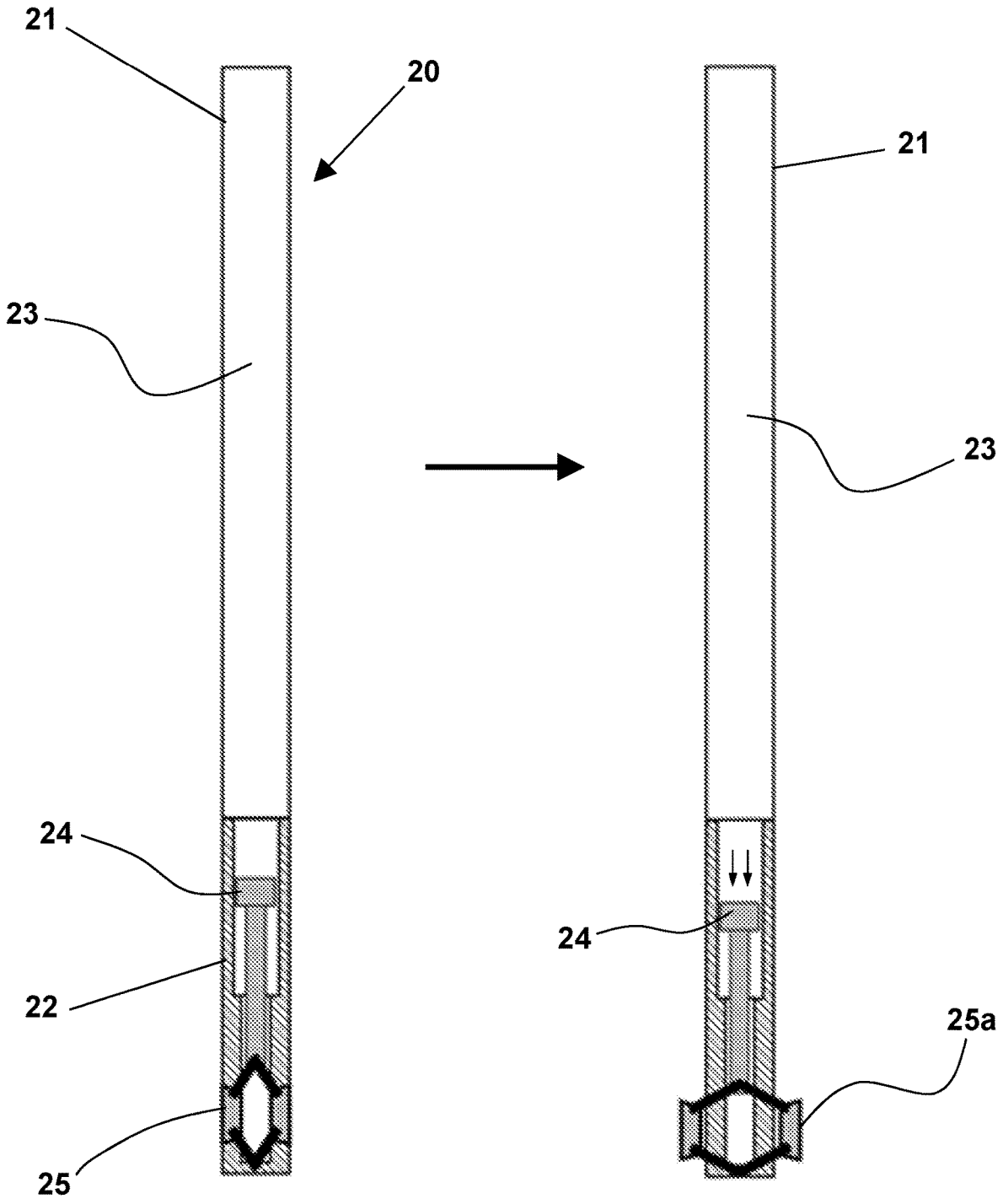
FIG. 3 shows a portion of a downhole tool assembly of the present invention with a preferred embodiment of a slips functional component.

FIG. 3 shows a downhole tool assembly 20 that comprises a further preferred embodiment of functional component, in the form of slips. It is envisaged that slips represent a functional component that is associated with both the deployment of alloy plugs/seals and also the removal/clearance of well structures.

Slips are typically employed to enable a downhole tool to engage with, and secure the tool in position relative to, a surrounding well structure, such as well tubing or well casing.

As in the assembly 10 shown in FIG. 2, the functional component (i.e. the slips) is provided below the chemical heater 21. With that said, unlike the expandable base which must always be positioned below the heater to perform its function, it is envisioned that slips can be provided below and/or above the chemical heater and still perform their function of retaining the assembly in position relative to the surrounding well structure in the borehole.

Therefore, although FIG. 3 only shows the slips functional component being positioned downhole of the chemical heater, it will be appreciated that this is not the only arrangement possible within the scope of the present invention.

Turning now to the operation of the slip functional component, it can be seen from FIG. 3 that the main body 22 of the slips is connected to the leading end of the chemical heater 21. As with the arrangement shown in FIG. 2, the connection between the chemical heater and the main body 22 should be gas tight to ensure that any built up of gas within the chemical heater can be focused on actuating the piston 24, which is slidably retained within the main body 22.

As will be appreciated from FIG. 3, the action of the gas built up within the chemical heater 21 during the exothermic reaction of the chemical heat source 23 causes the piston 24 to be urged downwards away from the chemical heater. This movement of the piston is transferred to the slips 25, which are configured to project radially outward towards any surrounding well structure.

It will be appreciated that the slips may be provided with gripping means (e.g. a high friction surface) that helps facilitate a strong grip between the projecting slips 25A and the inner surface of the surrounding well structure (not shown). Although not shown, it is envisaged that the slips may mechanically lock into position once they are driven passed a certain point by the actuating piston 24.

Alternatively, the slips may be retained in position by the continued action of the gas within the chemical heater on the actuator.

In those arrangements where the slips are held in position by the continued pressure within the chemical heater, it is appreciated that pressure release means may be employed to facilitate the disengagement and retraction of the slips by venting the gas built up within the chemical heater.

Figure 4:
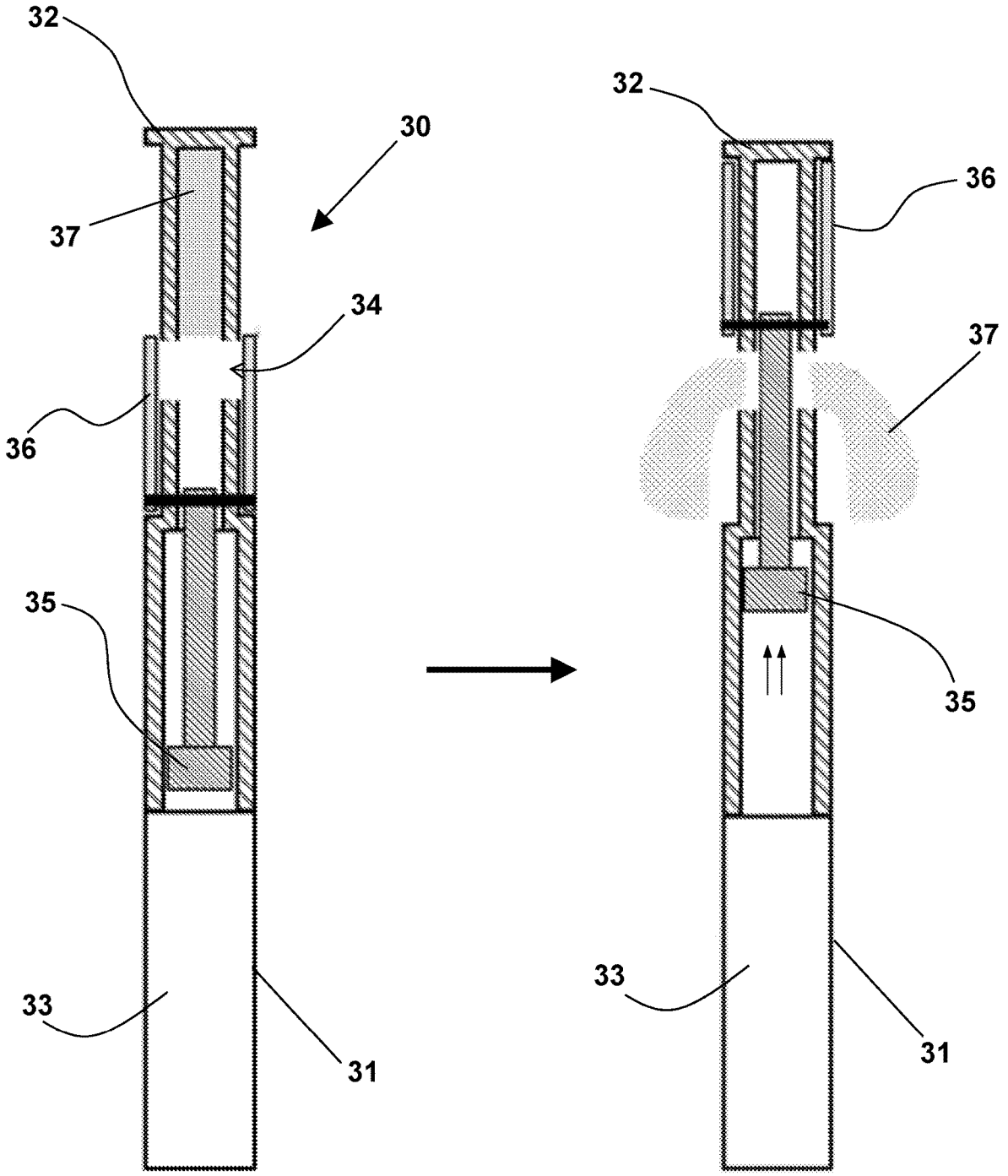
FIG. 4 shows a portion of a downhole tool assembly of the present invention with a preferred embodiment of a dump bailer functional component.

FIG. 4 shows yet example of a preferred functional component that can be provided on a downhole tool assembly of the present invention and operated using the gas generated by the chemical heat source of the chemical heater.

The downhole tool assembly 30, which is shown in part in FIG. 4, comprises a dump bailer 32 functional component connected to the top of chemical heater 31. As in the embodiments shown in FIGS. 2 and 3, the function component (in this case the dump bailer) is connected to the main body of the chemical heater with a gas tight seal. Again this could be achieved in a number of ways, including a screw thread fit and/or a welded joint.

As explained above, the creation of the gas tight seal between the chemical heater and the dump bailer ensures that any gas generated by the exothermic reaction of the chemical heat source (e.g. thermite mixture) 33 enclosed within the chemical heater 31 can be harnessed and used to act on an actuator 25 that operates the dump bailer to deploy its alloy load into a downhole target region.

As with the arrangements shown in FIGS. 2 and 3, the actuator is arranged in fluid communication with the interior of the chemical heater such that the pressure build-up of gas during the exothermic reaction of the thermite mixture imparts a driving force on the piston 35 and pushes it away from the chemical heater.

The dump bailer is provided with alloy holding portion that is provided with one or more ports 34 through which the alloy can exit the dump bailer. In order to enable the free flow of alloy even when it is in an un-melted state, the alloy 37 is typically provided in the form of pellets or beads.

In order to retain the alloy in the dump bailer until it is required, said ports 34 are covered by a gate or sleeve 36 that is mounted on the dump bailer in such a way that it can be slid away from the ports to allow the alloy to exit the holding portion of the dump bailer.

It is envisaged that the gate/sleeve is retained in the closed position by default, preferably under the action of a resilient biasing means. However, upon activation of the chemical heater, and the subsequent generation of gas, the movement of the piston 35 within the main body of the dump bailer is transferred to the gate or sleeve such that it is moved and the ports 34 are exposed to allow the alloy to exit the dump bailer.

It will be appreciated that the above described arrangement allows the act of initiating the chemical heater to trigger the subsequent deployment of alloy from the dump bailer without the need for a second signal being sent to the downhole tool assembly.

Figure 5:
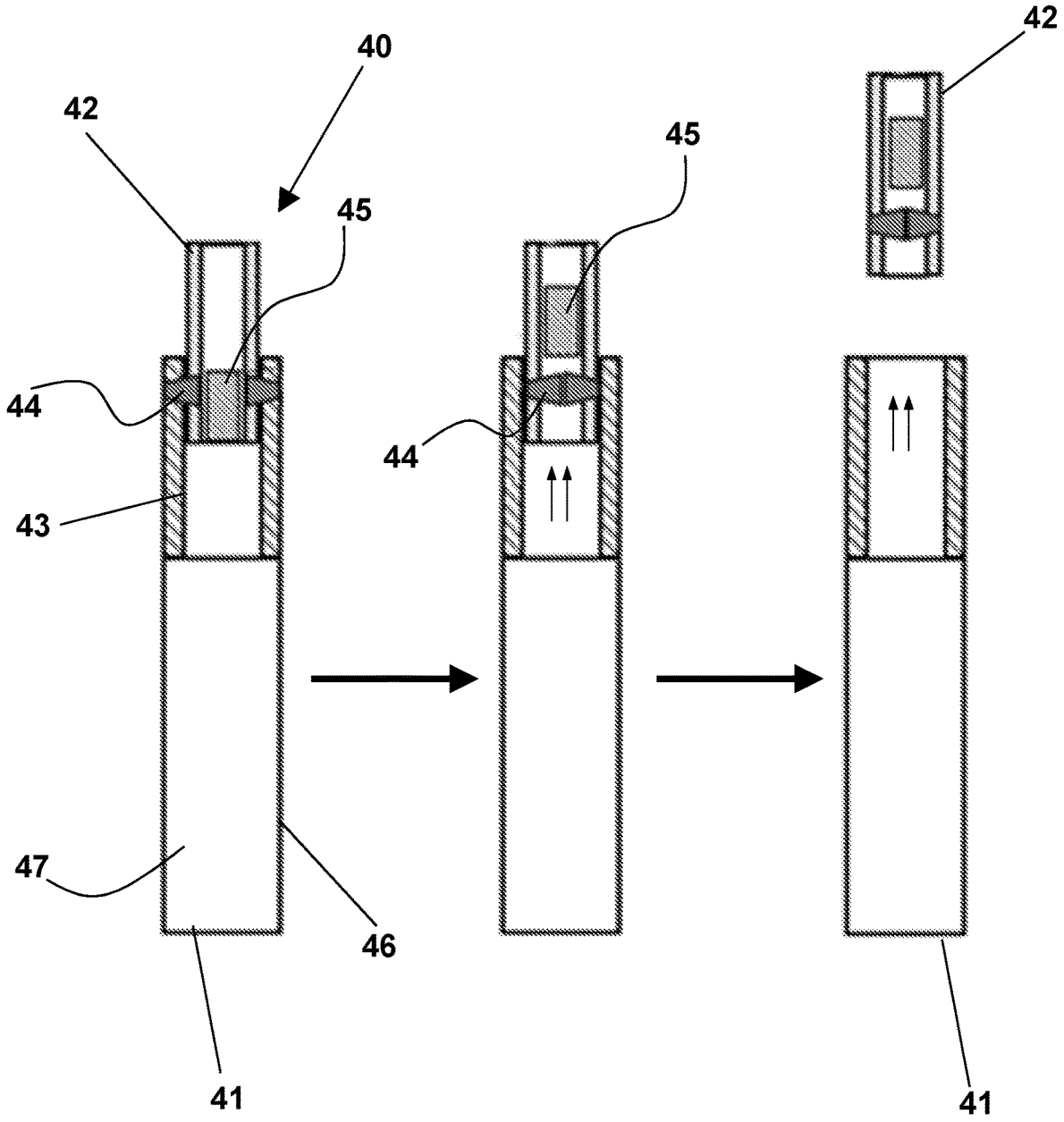
FIG. 5 shows a portion of a downhole tool assembly of the present invention with a preferred embodiment of an assembly component connection mechanism functional component.

FIG. 5 shows a further example of a functional component, which can be operated using the gas generated during the exothermic reaction of the chemical heat source, in the form of an assembly component connection mechanism 43. In FIG. 5 the assembly 40 is formed from two parts 41, 42 that are connected to one another by the assembly component connection mechanism 43.

The assembly component connection mechanism 43 shown comprises a locking ring 44 that is held in an expanded state by the presence of retaining block 45. In its expanded state the ring 44 projects radially outwards from second part 42 of the assembly and is received within a radial groove provided in the first part 41 of the assembly.

Although the retaining block 45 is configured to be slidable within an interior channel within the second part 42 of the assembly, the presence of resilient biasing means (not shown) ensure that the retaining block defaults to a locking position in which the ring 44 is maintained in its expanded state by the block 45 (see first stage of FIG. 5).

A chemical heater 46, with a suitable gas generating chemical heat source 47 in accordance with the present invention, is provided in the first part 41 of the assembly 40. Upon activation of the chemical heater 46, gas and heat are generated as the chemical heat source 47 undergoes an exothermic reaction.

As the gas builds up within the chemical heater it begins to act on the retaining block 45. Upon reaching a predetermined pressure the gas will overcome the resilient biasing means that urge the retaining block 45 towards its default position and the block will be pushed away from the chemical heater 46 thereby releasing the locking ring 44.

Once the retaining block 45 has been moved away from the locking ring 44, the ring is free to return to an unexpanded state (see second stage of FIG. 5) and in so doing retreat from the annular groove of the first part 41 of the assembly 40.

Following the disengagement of the locking ring 44 from the groove, the first and second parts 41, 42 of the assembly are no longer locked together and the second part 42 can be separated from the first part 41 (see final stage of FIG. 5).

Once the assembly component connection mechanism 43 has been operated, the second part 42 of the assembly 40 can be retrieved from the downhole target region.

It is envisaged that the various examples of gas operated functional components described above could be used in a range of combinations on a downhole tool assembly to deploy an alloy plug or seal in a variety of downhole environments.

In embodiments where multiple functional components are provided on a downhole tool assembly, it is envisaged that the chemical heater can be configured to coordinate the order in which the different functional components are operated under the action of the gas generated by the chemical heat source of the chemical heater.

In particular it is envisaged that in configurations where different functional components are provided at either end of the chemical heater, the chemical heat source of the chemical heater may be composed of more than one gas generating thermite mixture.

In particular, each functional component may be operated by gas generated by a different thermite mixture, wherein the respective mixture is positioned close to the end of the chemical heat at which its associated functional component is located.

By using separate gas generating thermite mixtures to operate functional components located at opposite ends of the chemical heater it is possible to control the order in which the functional components are operated by increasing/decreasing the gas production rate of each mixture accordingly.

Alternatively, or indeed additionally, the order in which multiple functional components are operated by the gas generated in the chemical heater can also be regulated by selected the strength of the resilient biasing means associated with each actuator.

It is envisaged that in this way increasing the strength of the resilient biasing means urging the actuator towards the default position can delay the operation of the functional component (i.e. because the gas pressure required to overcome the biasing force is greater), whilst reducing its strength can speed up the operation (i.e. because a lower gas pressure is required to overcome the reduced biasing force).

It is appreciated that configuring the actuators of the functional components in this way is particularly suitable when a single gas generating thermite mixture is used within the chemical heater and also when multiple functional components are located at the same end (i.e. the leading end or the trailing end) of the chemical heater.

Figure 6:
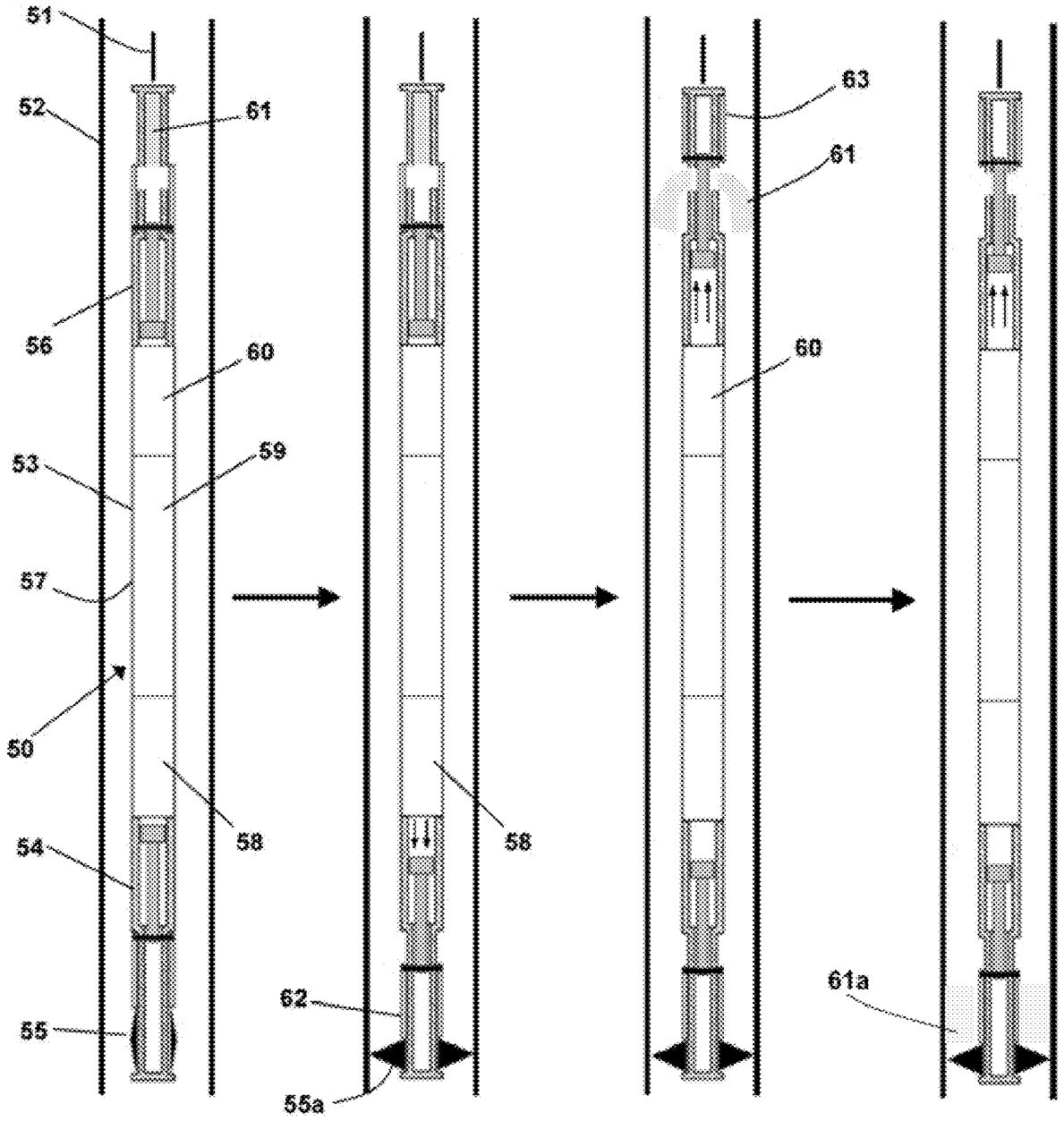
FIG. 6 shows the key stages of the down-hole operation of a preferred embodiment of the downhole tool assembly of the present invention.

A preferred embodiment of a downhole tool assembly 50 according to a first aspect of the present invention, which is provided with multiple functional components, is shown in FIG. 6.

The assembly 50 is delivered down hole into a well tubing 52 using a delivery support 51, such as a wireline, that is connected to a suitable delivery means provided at the surface of the well.

The assembly 50 comprises a chemical heater 53 with a first functional component connected to the heater at the leading end (i.e. the end that is deployed downhole first) of the assembly and a second functional component connected to the heater at the trailing end of the assembly.

The first functional component is an expandable base 54 similar to that described above with reference to FIG. 2. The second functional component is a dump bailer 56 similar to that described above with reference to FIG. 4. Both functional components form a gas tight seal with the chemical heater (e.g. screw threaded connection).

As the manner in which both functional components are operated has been described above it will not be described again here. Instead the overall operation of the downhole tool assembly 50 will be described.

With that said, it will be appreciated that the chemical heater 53 is provided with three distinct chemical heat sources 58, 59 and 60. The chemical heat sources positioned 58 and 60 at either end of the chemical heater are provided in the form of gas generating thermite mixtures, whereas the chemical heat source located in the middle is provided in the form a non-gas generating thermite mixture.

In the first stage shown in FIG. 6 the assembly 50 is deployed into a well tubing 52 using a wireline as a delivery support. The skilled person will appreciate that other types of delivery support (e.g. slick line, coil tubing) could be used without departing from the scope of the present invention.

Once in position in a target region within the well tubing 52 the chemical heater and the enclosed chemical heat sources 58, 59 and 60 are initiated and the exothermic reaction commences.

The composition of chemical heat source 58, which is a gas generating thermite mixture, is configured to produce gas at greater rate than chemical heat source 60. This is so that the expandable base is the first of the two functional components to be operated following the initiation of the heater.

It is envisaged that the operation of the expandable base 54 may be further prioritized over the dump bailer 56 by configuring its actuator to offer less resistance to being displaced from its default position than the actuator that operates the dump bailer.

In the second stage shown in FIG. 6 the gas generated by the lowest chemical heat source 58 is sufficient to urge the actuator associated with the expandable base away from the chemical heater.

As described above in relation to FIG. 2, this action causes the elastomeric ring 55 of the expandable base 54 to project radially outward towards the inner walls of the surrounding well tubing 52. In this way the expandable base 54 forms a platform below the target region.

As the exothermic reaction continues within the chemical heater 53, the pressure of the gas generated by the upper chemical heat source 60 reach a level that is sufficient to overcome the biasing forces holding the dump bailer 56 closed. At this point, and as described above with reference to FIG. 4, the action of the gas on the actuator causes the dump bailer to open and deploy its alloy cargo, which is provided in a flowable form such as beads or pellets, into the target region. This deployment of the alloy 61 is shown in the final stage of FIG. 6.

The alloy 61, which is prevented from falling passed the assembly 50 by the presence of the expanded base 55*a*, is then heated and melted by the combined heat generated by the three chemical heat sources 58, 59 and 60.

After the alloy 61 has been melted the alloy is allowed to cool again. As the alloy cools an alloy seal/plug 61*a* is formed within the target region.

Although FIG. 6 shows the operation of an assembly in the formation of a plug within well tubing, it is envisaged that the same assembly could also be employed to deploy an alloy seal into the annulus surrounding the well tubing, if suitable perforations/apertures were provided in the well tubing.

The above described embodiments are provided to demonstrate the various functional components that can be operated using the gas generated by the chemical heater of a downhole tool assembly. The examples are not intended to be limiting and it is envisioned that other functional components that are associated with the formation and indeed the removal of downhole alloy seal/plugs could be combined with gas generating chemical heaters in downhole tool assemblies that fall within the scope of the present invention.

The invention claimed is:

1. A downhole tool assembly for use in deploying an alloy plug or seal within a target region of an oil/gas well, said assembly comprising:

a chemical heater with a main body that defines an enclosure that houses a chemical reaction heat source that contains at least one gas generating additive, wherein the chemical reaction heat source is configured to generate sufficient heat to melt alloy within a downhole environment in order to form said alloy plug or seal in the target region; and at least one functional component associated with the deployment of the alloy plug or seal, each component being configured to be operated by the action of an actuator;

wherein each actuator is arranged in fluid communication with the enclosure of the chemical heater such that, in use, gas generated during the reaction of the chemical reaction heat source is harnessed to drive the actuator, which acts either directly or indirectly, to operate said functional component.

2. The assembly of claim 1, further comprising an alloy, which is preferably a bismuth-based alloy, for use in the formation of the alloy seal.

3. A downhole tool assembly for use in removing or clearing a well structure from a target region of an oil/gas well, said assembly comprising:

a chemical heater with a main body that defines an enclosure that houses a chemical reaction heat source that contains at least one gas generating additive, wherein the chemical reaction heat source is configured to generate sufficient heat to facilitate removal or clearance of the well structure within a downhole environment; and at least one functional component associated with the removal or clearance of the well structure, each component being configured to be operated by the action of an actuator;

wherein each actuator is arranged in fluid communication with the enclosure of the chemical heater such that, in use, gas generated during the reaction of the chemical reaction heat source is harnessed to drive the actuator, which acts either directly or indirectly, to operate said functional component so as to effect removal or clearance of the well structure from the target region.

4. The assembly of claim 3, wherein the well structure is selected from a group that contains: an alloy plug or seal; a well tubing/casing; previously deployed well tools; cabling, tubing and other lines deployed within the oil/gas well.

5. The assembly of claim 1 or 3, wherein the chemical reaction heat source comprises a thermite based heat source.

6. The assembly of claim 5, wherein the thermite based heat source comprises:

between 7.5 and 35.5% by weight of an oxidizable metal;

between 64.0 and 92.0% by weight of an oxidizing reagent; and between 0.5 and 30.0% by weight of said gas generating additive.

7. The assembly of claim 1 or 3, wherein said gas generating additive is a metal carbonate that is preferably selected from a group consisting of $BaCO_3$, $BeCO_3$, $ZnCO_3$, $MgCO_3$, $CaMg(CO_3)_2$, $CaCO_3$, $SrCO_3$, $MnCO_3$, $Fe(CO_3)_2$ and combinations thereof.

8. The assembly of claim 6, wherein the oxidizable metal is selected from a group consisting of Al, B, Mg, Mn, Ti, AlSi and AlMg.

9. The assembly of claim 6, wherein the oxidizing reagent is selected from a group consisting of CuO, $Cu_2O$, $Cr_2O_3$, $WO_3$, $Fe_2O_3$, $Fe_3O_4$, $MnO_2$, $Bi_2O_3$, $MoO_3$ and $PbO_2$.

10. The assembly of claim 6, wherein the thermite based heat source is provided in the form of pellets, a paste, a powder, solid block(s), fragmented solid block(s), a liquid or combinations thereof.

11. The assembly of claim 6, wherein the chemical heater enclosure houses one or more solid blocks of thermite material and at least one solid block is formed from thermite based heat source that contains said at least one gas generating additive.

12. The assembly of claim 11, wherein the amount of gas generating additive present in each block varies from block to block.

13. The assembly of claim 11, wherein each actuator is arranged adjacent a solid block formed from the thermite based heat source that contains at least one gas generating additive.

14. The assembly of claim 11, wherein said one or more solid blocks comprise one or more bores running through them, such that when the blocks are stacked within the heater enclosure the bores align to facilitate the passage of gas therethrough.

15. The assembly of claim 1 or 3, wherein the pressure built up within the enclosure of the chemical heater by the generation of gas acts, via said actuator, to directly operate said at least one functional component.

16. The assembly of claim 1 or 3, wherein the pressure built up within the enclosure of the chemical heater by the generation of gas acts, via said actuator, to indirectly operate said at least one functional component(s).

17. The assembly of claim 16, wherein said actuator releases stored potential energy that operates said at least one functional component(s); and wherein preferably the potential energy is stored in the form of a depressurised region of the assembly or an elastically deformed spring.

18. The assembly of claim 1 or 3, wherein:

a) said at least one functional components associated with the deployment of the alloy plug or seal include a dump bailer, an expandable base, an expandable heat retaining baffle, slips, and an assembly component connection mechanism; and b) said at least one functional components associated with the removal or clearance of the well structure include a perforation tool, an expandable junk basket, an expandable heat retaining baffle, slips, and a well structure retrieval mechanism.

19. The assembly of claim 1 or 3, comprising a plurality of functional components that each have an associated actuator, such that the operation of each one of said plurality of functional components is independently controllable.

20. The assembly of claim 19, wherein the actuators are configured such that the plurality of functional components are operated in a pre-determined order.

21. A method of deploying an alloy plug or seal within a target region of an oil/gas well using a downhole tool assembly having a chemical heater and at least one functional component associated with the deployment of the alloy plug or seal, said method comprising:

providing the chemical heater with a chemical reaction heat source that contains at least one gas generating additive;

delivering the downhole tool assembly to a target region within the oil/gas well and initiating the chemical reaction heat source of the chemical heater to generate heat in order to melt alloy, which, upon cooling, forms said alloy plug or seal within said target region;

harnessing the gas generated during the reaction of the chemical reaction heat source within the chemical heater to drive an actuator that acts, either directly or indirectly, to operate said at least one functional component.

22. A method of removing or clearing a well structure from a target region of an oil/gas well using a downhole tool assembly having a chemical heater and at least one functional component associated with the removal or clearance of the well structure, said method comprising:

providing the chemical heater with a chemical reaction heat source that contains at least one gas generating additive;

delivering the downhole tool assembly to a target region within the oil/gas well and initiating the chemical reaction heat source of the chemical heater to generate heat to facilitate removal or clearance of the well structure; and harnessing the gas generated during the reaction of the chemical reaction heat source within the chemical heater to drive an actuator that acts, either directly or indirectly, to operate said at least one functional component so as to remove or clear the well structure from said target region.

23. The method of claim 21 or 22, wherein the chemical reaction heat source comprises a thermite based heat source.

24. The method of claim 23, wherein the thermite based heat source comprises:

between 7.5 and 35.5% by weight of an oxidizable metal;

between 64.0 and 92.0% by weight of an oxidizing reagent; and between 0.5 and 30.0% by weight of said gas generating additive.

25. The method of claim 21 or 22, wherein:

a) said at least one functional components associated with the deployment of the alloy seal include a dump bailer, an expandable base, an expandable heat retaining baffle, slips, and an assembly component connection mechanism; and b) said at least one functional components associated with the removal or clearance of the well structure include a perforation tool, an expandable junk basket, an expandable heat retaining baffle, slips, and a well structure retrieval mechanism.

26. The method of claim 21 or 22, wherein, when the downhole tool assembly comprises a plurality of the at least one functional components including an expandable base, the operation of the functional components is prioritised so that the expandable base is operated first.

27. The method of claim 21 or 22, wherein, when the downhole tool assembly comprises a plurality of the at least one functional components including an assembly component connection mechanism, the operation of the functional components is prioritised so that the assembly component connection mechanism is operated last.

28. The method of claim 21 or 22, wherein the operation of the at least one functional components is prioritised by configuring the actuator associated with each functional component.

* * * * *